United States Patent [19]

Fapiano et al.

[11] 4,137,741

[45] Feb. 6, 1979

[54] WORKPIECE SHAPE CONTROL

[75] Inventors: Donald J. Fapiano, Salem; Edward E. Tablett, Troutville, both of Va.

[73] Assignee: General Electric Company, Salem, Va.

[21] Appl. No.: 863,110

[22] Filed: Dec. 22, 1977

[51] Int. Cl.[2] ..... B21B 37/00

[52] U.S. Cl. ..... 72/6; 72/19

[58] Field of Search ..... 72/6–12, 72/16, 19

[56] References Cited

U.S. PATENT DOCUMENTS 3,248,916 5/1966 Kenyon et al. ..... 72/16 X 3,630,055 12/1971 Fapiano ..... 72/6

3,714,805 2/1973 Stone ..... 72/8

FOREIGN PATENT DOCUMENTS 50-18869 7/1975 Japan ..... 72/9

*Primary Examiner*—Milton S. Mehr

*Attorney, Agent, or Firm*—Arnold E. Renner

[57] ABSTRACT

A method of controlling the shape of a workpiece in a rolling mill through the control of workpiece crown as the workpiece is being rolled includes the calculation of the roll-separating force required on each reducing pass as a function of roll elasticity, diameter and crown and workpiece resistance to deformation, width, entry crown and target crown.

5 Claims, 4 Drawing Figures

WORKPIECE SHAPE CONTROL

BACKGROUND OF THE INVENTION

The present invention relates generally to workpiece shape control in a rolling mill and more particularly to the control of workpiece shape through control of workpiece crown.

Workpiece crown is used here in its usual sense to denote the difference in thickness between the center and the edges of a workpiece. When the center is thicker than the edges, the workpiece is said to have positive crown while if the workpiece is thinner in the center than at the edges it is said to have negative crown. Positive crown is by far the more common occurrence. One aspect of workpiece shape control is workpiece flatness; that is, the workpiece does not exhibit centerline buckle nor wavy edges. Centerline buckle is normally occasioned by a greater elongation at the workpiece center than at the edges such that the resultant increased elongation shows up in a buckle in the center of the workpiece whereas wavy edges are occasioned by a greater elongation at the edges of the workpiece than at the center. Thus, by controlling the workpiece crown, the relative reductions of the center and the edges, and hence the flatness, are controlled.

For a more complete description of the various reasons for having crown in a workpiece and for a description of a system in which crown control is used to control workpiece shape, reference is made to U.S. Pat. No. 3,630,055, "Workpiece Shape Control" by D. J. Fapiano et al, issued Dec. 28, 1971 and assigned to the assignee of the present invention. This patent is specifically incorporated hereinto by reference and describes and claims a method over which the present invention is an improvement. The U.S. Pat. No. 3,630,055 describes a system for workpiece shape control which is subject to automation and which recognizes that the workpiece crown is a function of mill and workpiece dimensions, rolling force, and workpiece resistance to deformation. That patent also recognizes that workpiece flatness is not totally dependent upon the crown but can be modified independently of the final plate crown by altering the per unit workpiece crown on successive passes. This latter feature was accomplished through the use of what is there described and identified as a "crown slope multiplier" (CSM). The CSM is a factor having a magnitude greater than unity and represents the relative deformation a workpiece may experience without exhibiting wavy edges or center buckle. This factor of CSM results largely from the ability of the material to withstand interboundary stresses and normally increases with the material thickness but is also affected by parameters such as material composition and temperature. The actual values of CSM are usually empirically derived for the materials being rolled as a function of the various parameters.

The system of the U.S. Pat. No. 3,630,055 patent exercised control to establish a particular crown during each pass by determining the roll separating force necessary to produce that crown in accordance with the equation:

$$F = (RM)(RD)[(MH)(PCW)(TC) + (RCW)(ERC)].$$

In this equation and in accordance with that patent, RM is proportional to the modulus of elasticity of the rolls, RD is proportional to the diameter of the rolls, MH is proportional to the resistance to deformation of the workpiece, PCW and RCW are proportional to the width of the plate, TC is proportional to the target crown on the workpiece, and ERC is proportional to the effective crown on the rolls.

The method represented by and employing the above formula is entirely satisfactory for the majority of metal hot rolling requirements. It has been more recently determined, however, that in certain instances the results achieved by the use of the method set forth in the patent are not, in all cases, as accurate as might be desired. This is particularly true when the workpiece is being rolled at lower than normal temperatures, for improved physical characteristics, or when the delivered workpiece is very thin. The basic deficiency which has been found to exist at these times is primarily the result of the fact that the prior art method as specified above assumes negligible correlation between entry and delivery workpiece crowns. In addition, this prior art method does not accommodate negative workpiece crowns and severely restricts allowed crown changes in the case of very low final workpiece crowns. This latter restriction can create difficulties in some present day rolling practices in which the final finishing roll force is specified by the mill operator rather than by the control system. Should the specified force result in a zero or negative finished workpiece crown, the system of the prior art just described would not operate properly. This condition, of course, does not arise when finishing force is designated by the control system, but this optional operating mode is sometimes valuable.

SUMMARY OF THE INVENTION

It is, therefore, an object of the present invention to provide an improved method of workpiece shape control.

It is a further object to provide an improved method of workpiece shape control through the control of workpiece crown.

It is another object to provide workpiece shape control through the use of crown control which improves upon the prior art control through the recognition that the entry crown of the workpiece can be a significant factor.

The foregoing and other objects have been satisfied in accordance with the present invention through the recognition that workpiece crown is a function not only of mill and workpiece dimensions, rolling force and workpiece resistance to deformation but also of entry crown. The present invention also recognizes that the workpiece flatness is not totally dependent upon crown and that there is independent modification available by varying the per unit crown on successive passes. Control is exercised in accordance with the present invention by first establishing a target corwn for each pass beginning with the final pass. Working backwards, beginning with the last pass and in response to the established target crowns, the roll separating forces required to produce the crowns are determined based upon prescribed mill and workpiece parameters. From the determination of force, the reduction and entry gage are calculated. Based upon these factors and the known mill stretch characteristics, the rolls can then be set at their proper openings for the pass of the workpiece.

BRIEF DESCRIPTION OF THE DRAWING

While the present invention is particularly defined in the claims annexed to and forming a part of this specification, a better understanding can be had from the following description taken in conjunction with the accompanying drawing in which:

DETAILED DESCRIPTION

Figure 1:
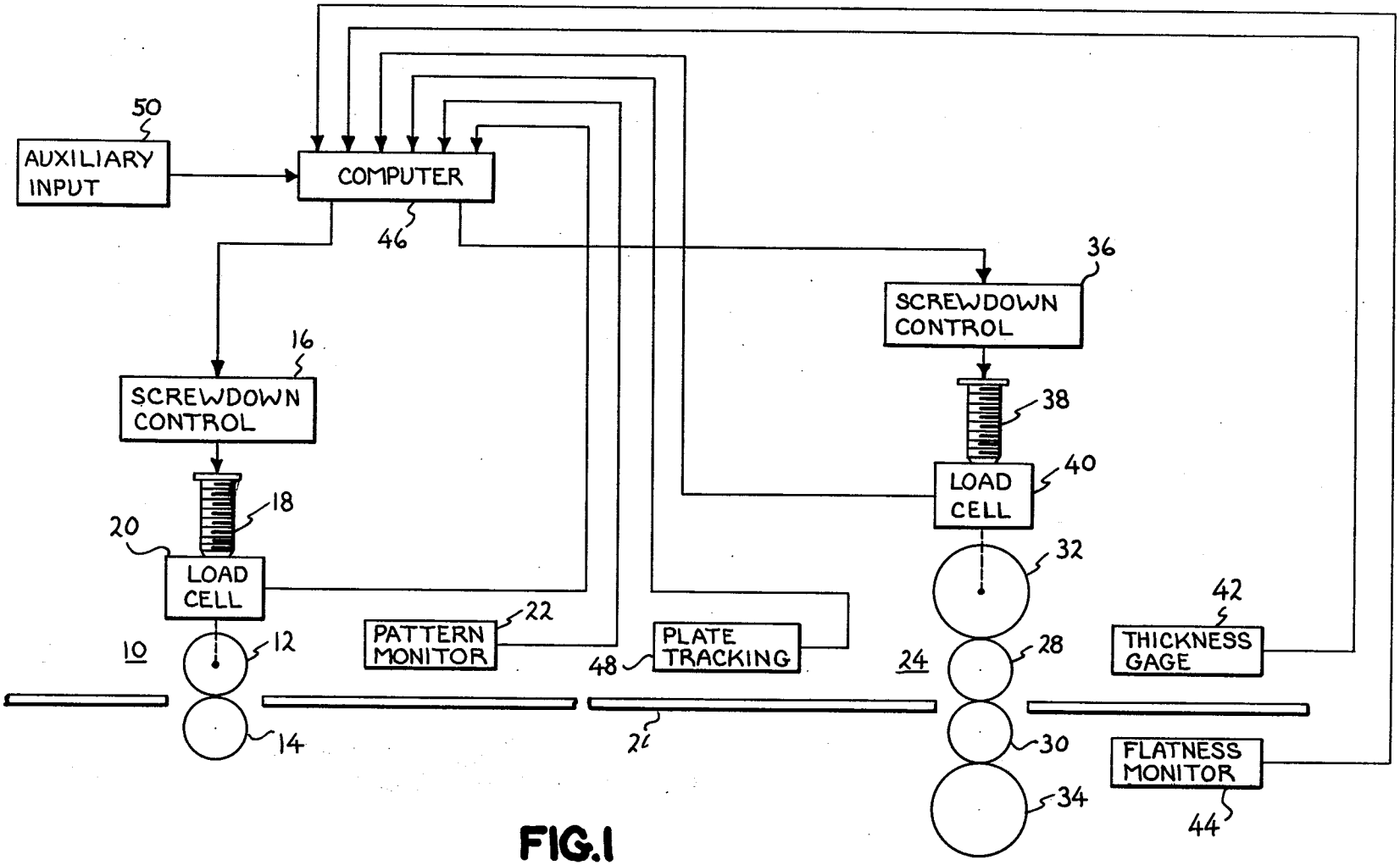
FIG. 1 is a block diagram of the environment and elements utilized in the practice of the present invention; and, FIGS. 2, 3 and 4 are graphs of the effects of workpiece width on force multipliers appearing in the crown-force equation of the present invention.

Reference is now made to FIG. 1 which illustrates a typical environment within which the method of the present invention would find use. Those familiar with U.S. Pat. No. 3,630,055, which, as previously mentioned, is specifically incorporated hereinto by reference, will recognize FIG. 1 as being essentially identical to FIG. 1 of that patent and as showing the apparatus for the process of reducing a short, thick metal slab to a much longer, much thinner finished metal workpiece. This process is often carried out in two successive phases called, respectively, the roughing phase and the finishing phase. During the roughing phase, the heated slab may be reduced to a desired gage and a desired length by passing it back and forth through a roughing mill, shown generally at 10, which consists of a pair of reversibly driven work rolls 12 and 14. The distance between adjacent faces of the work rolls 12 and 14 is reduced with each succeeding pass by a screwdown mechanism including a screwdown control 16 which controls the angular position of a screw 18 threaded through an anchor nut (not shown) in the housing of the roughing mill 10. The roll separating forces produced by the passage of workpiece between the work rolls 12 and 14 are monitored by a load cell 20 which may be, for example, interposed between the lower end of the screw 18 and the end support for the work roll 12. Although a single screw 18 is shown, it is to be understood that an identical screw is located above the opposite end support of the work roll 12.

The objective of the roughing phase is to produce a slab of predetermined length and rectangular configuration or pattern when viewed from above. In the roughing mill, slab pattern is monitored by an element referred to as a pattern monitor 22. In practice, the function of monitoring a pattern of a slab is generally performed by an operator although it is becoming increasingly more common to use other mechanisms such as is described in the aforementioned U.S. Pat. No. 3,630,055.

Upon completion of the roughing phase, the workpiece may be turned 90° before delivery to a finishing mill 24 located along a mill table 26. In FIG. 1, the finishing mill 24 is shown as a single stand 4-high reversing mill through which the workpiece is reversibly and repeatedly passed to effect reduction in the workpiece thickness. As such, mill 24 includes a pair of reversibly driven work rolls 28 and 30 and a pair of larger backup rolls 32 and 34. As in the roughing mill, the relative positions of the work rolls 28 and 30 are controlled by a screwdown mechanism including a screwdown control 36 which controls the angular position of a screw 38 through an anchored nut (not shown) associated with the housing for the finishing mill 24. A second screw (not shown) also exists in the finishing mill at the opposite end of the backup roll 32. (It should be noted that other adjusting means such as known hydraulic roll positioning means could be used in place of the screws in both the roughing and finishing mills.) A finishing mill such as that shown at 24 differs from the roughing mill shown at 10 primarily by the inclusion of the backup rolls 32 and 34 which serve to distribute the screwdown forces exerted by the screws along the face of the work rolls 28 and 30. As shown in FIG. 1, the roll separating forces caused by the passage of the plate between the work rolls 28 and 30 are monitored by load cell 40 interposed between the screw 38 and one end support of the backup roll 32.

It is possible to use the same mill for roughing and finishing purposes. It is also quite common in the finishing phase to not use a reversing mill such as has been illustrated in FIG. 1 but to use what is commonly known as a tandem mill. The tandem mill provides a plurality of stands located along the table such that the finishing process is achieved by a single pass of the workpiece through the several stands all in a manner well known in the art. For this reason, in this specification including the claims which are found at the end, the rolling operations are described generally in terms of "passes." Whether or not these passes are carried out in a single mill serving both the roughing and finishing phases or in reversing or tandem mills is of no consequence in that the present invention has equal applicability to all these arrangements.

Returning to FIG. 1, the center and edge gages of the workpiece exiting the finishing mill 24 are determined by a thickness gage 42. The gage 42 can have separate gaging mechanisms located above the centerline and the edges of the workpiece or a single gage which scans across the workpiece transversely to the direction of travel. A mechanical device designated a flatness monitor 44 can be used to determine whether the finished workpiece is perfectly flat, has wavy edges or center buckle. (Such a device is described, for example, in the aforementioned U.S. Pat. No. 3,630,055 patent.) As a practical matter, however, an operator normally observes for flatness and submits coded observations indicating which of the flatness conditions exist. The coded observations are supplied to a computer 46 which also accepts signals from the load cells 20 and 40, the pattern monitor 22 and the thickness gage 42. Other inputs to the computer 46 are from a plate tracking system 48, which determines the position of the workpiece within the mill by means of a hot metal detector or similar sensor, and an auxiliary input 50. Auxiliary input 50 permits the input of data such as initial and final dimensions, workpiece composition, temperature, etc. Data on roll diameters and on the crowns of newly installed rolls may also be supplied through the auxiliary input 50.

While the computer 46 receives several input signals representing the end results of shape control in both the roughing mill 10 and the finishing mill 24, insofar as the present invention is concerned it provides only two output signals for effecting that shape control. The first of these output signals is supplied to the screwdown control 16 to adjust the angular position of the screw 18 and thus the relative position of the work rolls 12 and 14 in the roughing mill 10. The second of the output signals is supplied to the screwdown control 36 which adjusts the relative position of the work rolls 28 and 30 in the finishing mill 24.

As one step in determining the proper roll opening for establishing a particular crown during a particular pass, it is necessary to determine the roll separating force which will provide that crown. A crown force equation which is used in accordance with the present invention in carrying out crown control in either the roughing mill or the finishing mill is:

$$F = (RM)(RD)[(MH)(PCW)(TC) + (RCW)(ERC) - (ECW)(SEC)].$$

wherein:

F is the force per unit width to achieve the target crown,

RM is proportional to the modulus of elasticity of the opposed rolls,

RD is proportional to the diameter of the opposed rolls,

MH is proportional to resistance to deformation of the workpiece,

PCW is proportional to the width of the workpiece,

TC is proportional to the target crown for the workpiece,

RCW is proportional to the width of the plate,

ERC is proportional to the effective crown of the opposed rolls,

ECW is proportional to the width of the workpiece, and,

SEC is proportional to the entry crown of the workpiece.

Of the terms listed above, the roll modulus term RM, the roll diameter term RD and the effective roll crown term ERC represent mill characteristics, the deformation resistance term MH and the workpiece crown terms TC and SEC are characteristics of the workpiece, and the terms PCW, RCW and ECW are characteristics of the interaction between mill and workpiece. These interaction characteristics can be determined off line by a comprehensive mill deformation model which calculates force distributions and deformation components for given mill and workpiece conditions. Such models are well known to suppliers of mill equipment and rolling mill control systems.

Figure 2:
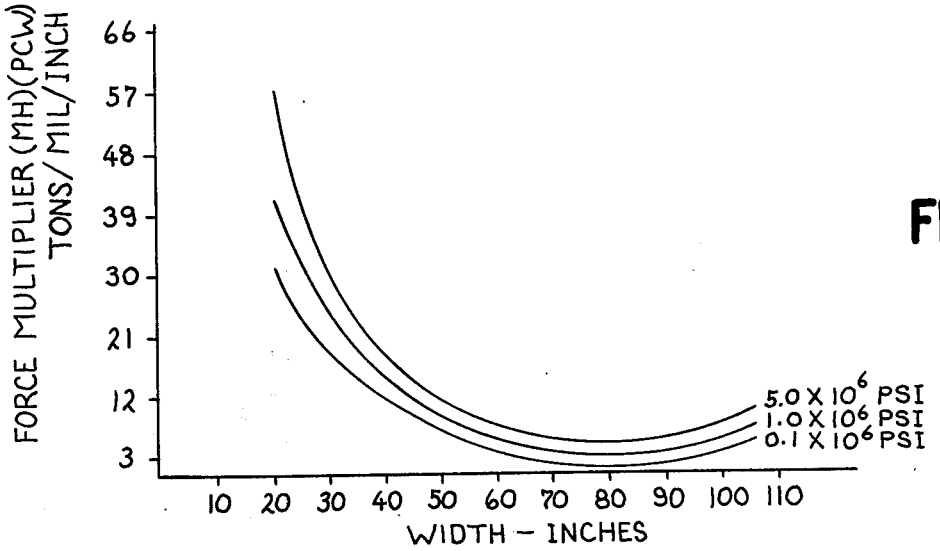

A comparison of this formula to that earlier given and which is used in the method of the aforementioned U.S. Pat. No. 3,630,055 shows that the equations are identical with the exception of the additional last portion; i.e., (ECW) (SEC), which appears in the present case. Inasmuch as all of the equation excepting this last portion is explained in detail in the aforementioned patent, it is believed unnecessary to repeat that detailed description here. Briefly, however, FIG. 2 shows a graph of the force multiplier (MH) (PCW) as a function of width for each of several incremental resistances to deformation. The three graphs of FIG. 2 are labeled $0.1\times10^6$ PSI, $1.0\times10^6$ PSI and $5.0\times10^6$ PSI. These numbers relate to the workpiece incremental resistances to deformation and the showing of FIG. 2 relates these resistances to the various workpiece widths. The units for the force multiplier (MH) (PCW) would typically be in tons per mil (of crown) per inch (of width). One additional explanation is believed desirable with respect to FIG. 2 as compared to the description in U.S. Pat. No. 3,630,055. In that patent, the term (PCW) was shown separately from the term (MH) by the graphs of FIGS. 3 and 6, respectively. FIG. 2 of this specification depicts the result of the multiplication of (MH) times (PCW). That is, FIG. 2 of this description corresponds to the product of FIGS. 3 and 6 of U.S. Pat. No. 3,630,055. The term TC is, of course, as was the case earlier, the target crown for a particular pass; that is, the desired crown at the exit of the rolls on any pass.

Figure 3:
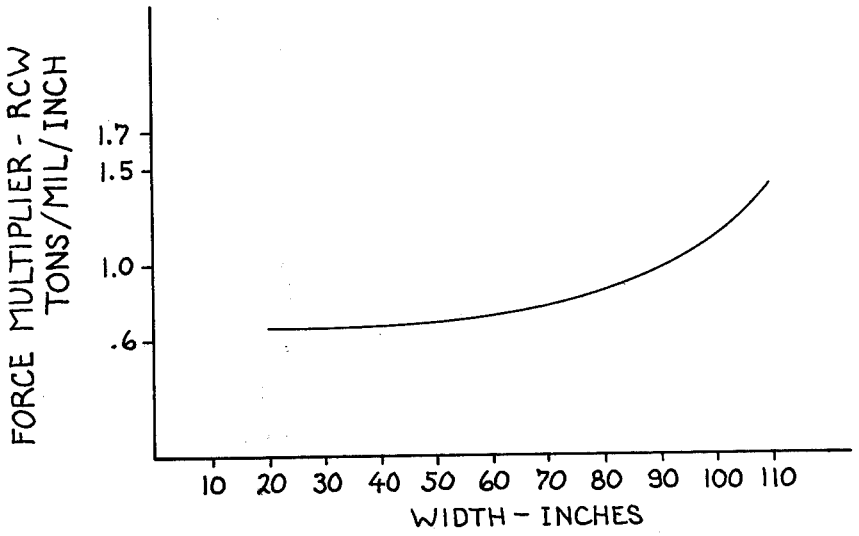
Figure 4:
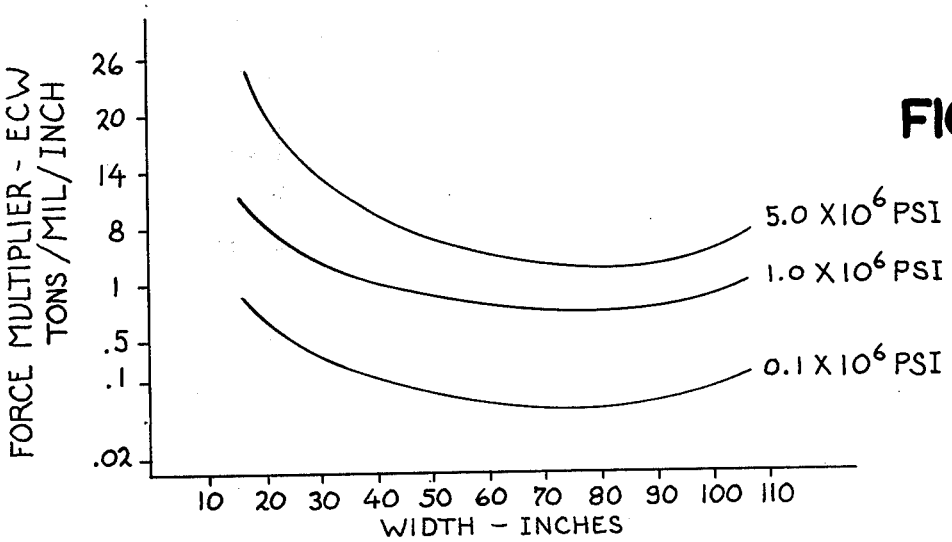

FIG. 3 here corresponds directly to FIG. 4 of the U.S. Pat. No. 3,630,055 patent and gives the force multiplier RCW in the same manner as there described. The slightly different shape in this showing illustrates only that the multiplier is here applied to a different mill resulting in a slightly different shape than is shown in this figure. The units on the force multiplier are, in this particular example, the same as for FIG. 2; i.e., tons per mil per inch. The term ECR is the effective roll crown as was explained in the aforementioned patent.

The remaining portion of the equation is the last term; that is, the portion (ECW) (SEC). FIG. 4 illustrates the relationship, for a typical mill, with respect to the force multiplier term ECW as a function of width. The three curves here shown correspond, respectively, to the three curves shown in FIG. 2 and are in the same units. The curves of FIGS. 2, 3 and 4 are the partial derivatives of force with respect to the specified parameter; that is, respectively, the crown of the workpiece upon delivery, the roll crown and the workpiece crown upon entry.

The term SEC which is the entry crown upon any particular pass will, of course, be the same as the delivered crown from the preceding pass as will be more fully understood as this description proceeds. In the manner described in the aforementioned U.S. Pat. No. 3,630,055, calculations are begun with the last pass and, hence, the term SEC for a particular pass will be equal to the term TC of the preceding pass. In that the problems of shape control during the finishing phase are far more complex than those encountered during the roughing phase, the present invention finds primary use at that time.

In setting up a rolling schedule in a mill in accordance with the present invention, the first step is a determination of a target crown for the last pass of the schedule. The target crown can be established by specified overweight limits or by other specifications or rules. For example, computer 46 may calculate a target crown which, recognizing the essentially parabolic form of the roll opening, is expressed in some absolute form for a given width. The expression as a function of width is normally desirable to avoid the possible excessive roll separating forces which might be necessary to roll a fixed absolute crown on a very narrow plate. Other strategies, of course, could be used. With the target crown for the last pass being determined along with the other terms of the crown force equation as shown, the equation can be used to calculate the roll separating force required during this pass to produce this target crown. It should be noted that one potential problem exists at this time in that while a target crown may be specified or known, the entry crown for the workpiece on that pass is not known. It has, however, been found that serious error will not occur if it is assumed that the entry crown and the exit crown are the same or related by a constant, CM, which will be defined later. Once the roll separating force required for the last pass is known, along with the desired exit gage of that pass, the entry gage for the last pass may be determined from well-known plate deformation curves which plot force as a function of draft (see, for example, FIG. 5 of U.S. Pat. No. 3,630,055.) The mill stretch will also be calculated in accordance with standard practice and based upon the stretch along with the crown, force, and gage determinations, the roll opening can be determined for the pass. Having accomplished this determination for the last pass, successive calculations of the same nature are then made for each of the earlier passes using, of course, the appropriate characteristics and assuming that the target crown and the entry crown are the same for each pass.

In the aforementioned patent, target crowns were computed utilizing greater than the crown slope multiplier (CSM) earlier mentioned. The CSM is a measure of the change in per unit crown which can be tolerated for successive passes in a rolling schedule for various workpiece dimensions and grade codes and as such could be stored as a matrix of values of the computer 46 (FIG. 1). In the same manner as was explained in the aforementioned patent, through the use of the crown slope multipliers, the target crowns for each of the preceding passes can be developed and the sequential solutions of the force equation of the present invention will then give the proper roll openings for each pass of the finishing mill. The actual application of the CSM term amounts to determining the workpiece per unit crown on a given pass by multiplying the per unit crown on the succeeding pass by the crown slope multiplier. To obtain absolute target crowns, it is necessary only to multiply the per unit crown by the workpiece thickness.

While the method employing crown slope multipliers is entirely satisfactory for most situations, it does not have the capability of accommodating negative workpiece crowns. In the past the inability of this strategy to accommodate negative workpiece crowns, and the severe restricting of allowed crown changes in the case of very low final workpiece crowns, was avoided by the manner in which the final workpiece crown was selected. That is, final workpiece crown was established by an algorithm included in the "shape" model which established workpiece crowns consistent with typical mill practice and with the overweight allowances specified by various production standards. At some installations, however, operating management has elected to permit the mill operators to designate target finishing force under some conditions. As such, there are instances when this force designation will result in a zero or negative finish workpiece crown which renders the crown slope multiplier method unusable. In order to be able to accommodate zero or negative final crowns, the present invention also contemplates, as an alternative to the use of the crown slope multiplier, the use of what is here termed a crown modifier (CM). Crown modifiers can be derived by converting the table of crown slope multipliers to crown modifiers using the following relationship:

$$CM = (CSM-1)C, \tag{1}$$

wherein C equals the per unit crown specified by the model for the width of workpiece, CM equals the crown modifier (per unit), and CSM equals the corresponding slope multiplier. As an example, for a workpiece width of 100 inches, a final thickness of 0.30 inches, a target crown of 0.005 inches; and, a CSM of 1.2:

$$C = (0.005/0.3) = 0.01667 \tag{2}$$

and CM is equal to 0.003333. Using the above equation, it is a simple matter to convert the entire CSM matrix to one of CM which could be used either at all times or as the alternative when the expected finished crown would prevent difficulties using the CSM system earlier described. It will be recognized that CSM and CM both represent limits on allowable change in workpiece crown on successive passes, and that at typical workpiece crown levels they will provide similar results. The values of CM are most conveniently derived from existing value of CSM where available, or can be established directly from rolling tests or other experience. The crown modifier term may be used to describe the crown relationship on successive passes (n−1 and n) in accordance with the following formula:

$$\text{Crown}_{n-1} = [(\text{Crown}_n)(h_{n-1}/h_n] \pm (CM)(h_n) \tag{3}$$

wherein h is workpiece delivery gage or thickness. (It will be noted that the first, bracketed term is the constant per unit crown for pass n−1, while the second term is the amount of crown change which the workpiece will accommodate on one pass without excessive distortion.)

Continuing with the procedural description, once the draft and entry gage have been determined for pass n, the crown on pass n−1 can be determined from equation (3) since all terms are now known. Equation (3) is also used in simplified form to estimate the crown on pass n−1 for use as the entry crown on pass n when calculating the crown force on pass n. The simplified form is:

$$\text{Crown}_{n-1} = (\text{Crown}_n) \pm (CM)(h_n). \tag{4}$$

Once the target force, draft and entry gage for pass n are calculated, it is possible to use equation (3) to find crown for pass n−1.

Thus, it is seen that there has been provided a method for performing shape control in a metal rolling mill which is more accurate than those previously known and which allows for rolling conditions not previously readily accommodated.

While there has been shown and described what is at present considered to be the preferred embodiment of the present invention, modifications thereto will readily occur to those skilled in the art. It is not desired, therefore, that the invention be limited to the specific arrangement shown and described and it is intended to cover in the appended claims all modifications that fall within the true spirit and scope of the invention.

What is claimed is:

1. For use in a rolling mill having at least one pair of opposed rolls, a method for controlling the shape of a workpiece based upon a specified final gage and crown comprising the steps of:

(a) establishing a target crown of the workpiece for each rolling pass beginning with the final pass;

(b) determining the roll separating force required to produce a target crown on the workpiece on each pass as a function of the effective roll crown, the modulus of elasticity of the opposed rolls, the diameter of the opposed rolls and the resistance to deformation, width, target crown, delivery gage and entry crown of the workpiece;

(c) determining the entry gage for each rolling pass, beginning with the last pass, as a function of the roll-separating force required on that pass, the desired delivery gage for the pass and plate deformation characteristics;

(d) predicting the stretch of the mill on each rolling pass as a function of the determined roll separating force and workpiece width;

(e) setting the roll openings for each pass as a function of the stretch of the mill and of the desired delivery gage for each pass; and, (f) passing the workpiece between the rolls following the setting of the roll openings.

2. The method in accordance with claim 1 wherein the target crown of the workpiece is established by first establishing a final target per unit crown for the workpiece and then establishing target per unit crowns for preceding passes by multiplying each previously established per unit crown by a crown slope multiplier having a magnitude greater than one whereby successively greater per unit crowns are established for earlier rolling passes.

3. The method in accordance with claim 1 wherein the target crown of the workpiece is established by first establishing a final target crown for the workpiece and then establishing target crowns for preceding passes by adjusting the target crown last previously established by a factor to give constant per unit crown and adding thereto an amount which is a function of a crown modifier and the workpiece thickness.

4. The method in accordance with claim 3 wherein each crown modifier (CM) is determined according to the equation:

$$CM = (CSM\text{-}1)C$$

wherein CSM is a crown slope multiplier having a magnitude greater than one and C is the final target per unit crown.

5. The method in accordance with claim 1 wherein the roll separating force per unit width (F) required to produce the target crown on the workpiece on each rolling pass is determined in accordance with the equation:

$$F = (RM)(RD)[(MH)(PCW)(TC)+(RCW)(ERC)-(ECW)(SEC)]$$

wherein, RM is proportional to the modulus of elasticity of the opposed rolls, RD is proportional to the diameter of the opposed rolls, MH is proportional to the resistance to deformation of the workpiece, PCW is proportional to the width of the workpiece, TC is proportional to the target crown for the workpiece, RCW is proportional to the width of the plate, ERC is proportional to the effective crown of the opposed rolls, ECW is proportional to the width of the workpiece and SEC is proportional to the entry crown of the workpiece.

* * * * *